United States Patent [19]

Feranda, Sr.

[11] Patent Number: 5,009,620

[45] Date of Patent: Apr. 23, 1991

[54] PROPELLER GUARD

[76] Inventor: Louis Feranda, Sr., 4251 W. Oquendo, Las Vegas, Nev. 89118

[21] Appl. No.: 529,188

[22] Filed: May 24, 1990

[51] Int. Cl.[5] ..... B63B 5/16

[52] U.S. Cl. ..... 440/72; 416/247 A

[58] Field of Search ..... 440/71, 72, 66, 67; 416/179, 247 R, 247 A

[56] References Cited

U.S. PATENT DOCUMENTS

| | | | |
|---|---|---|---|
| 983,587 | 2/1911 | Watkins . | |
| 2,319,640 | 5/1943 | Sink | 440/71 |
| 3,149,605 | 9/1964 | Broadwell | 115/18 |
| 4,070,984 | 1/1978 | Kappas | 5/16 |
| 4,078,516 | 3/1978 | Balius | 35/8 |
| 4,106,425 | 8/1978 | Gruber | 5/14 |
| 4,680,017 | 7/1987 | Eller | 5/16 |

FOREIGN PATENT DOCUMENTS

| | | | |
|---|---|---|---|
| 564057 | 9/1958 | Canada | 440/72 |
| 46998 | 2/1988 | Japan | 440/71 |
| 2152459 | 8/1985 | United Kingdom | 440/72 |

*Primary Examiner*—Sherman D. Basinger
*Assistant Examiner*—Stephen P. Avila
*Attorney, Agent, or Firm*—Quirk, Tratos & Roethel

[57] ABSTRACT

A propeller guard is provided with replaceable ribs that form a cage is placed around the propeller of an outboard marine propulsion unit. The ribs are suspended from a flat upper plate adapted to be bolted to a cavitation plate above the propeller. The ribs are maintained in spaced relation to each other around the propeller by the support plate and a longitudinally extending bottom bar bolted at one end to the skeg of the propulsion unit. In the event of damage to any of the ribs of the cage, the damaged rib can easily be replaced with a new one.

11 Claims, 4 Drawing Sheets

PROPELLER GUARD

This invention relates to propeller guards for outboard motor or stern drive marine propulsion units that will substantially encompass the propeller making it unlikely that swimmers, water skiers or scuba divers can come in contact with the rapidly rotating propeller or for the propeller to come in contact with floating or submerged objects.

BACKGROUND OF THE INVENTION

In the past a number of different propeller guards have been proposed. Examples of these guards are shown in Kappas U.S. Pat. No. 4,070,984; Balius U.S. Pat. No. 4,078,516; Gruber U.S. Pat. No. 4,106,425 and Eller U.S. Pat. No. 4,680,017. Primary objectives of the inventions disclosed in the exemplified patents included the following:

"To provide a marine propulsion unit whose screw cannot accidentally touch a human body."

"To provide a propeller guard for an outboard motor or a stern drive unit constructed in a manner whereby the guard will substantially fully enclose the propeller . . . and thus render it nearly impossible for swimmers to come in contact with the propeller or the propeller to come in contact with the bottom or other submerged objects when running in shoal waters."

"To provide a propeller guard constructed in a manner whereby it may be readily removed from engagement with and installed on various forms of drive units."

"To provide a motorboat propeller guard which protects the propeller from damage . . . ."

In addition to the safety aspects of the use of a propeller guard, the protection of the propeller from damage is an important consideration. It is estimated that many boat owners who make frequent use of their boats will buy two or three propellers a year because of damage to unprotected propellers caused by floating logs and debris or by backing into rocks and pilings. Many of the available propeller guards are complicated structures and are subject to damage by the same causes. The cost of repairing or replacing the propeller guard may approach or exceed the cost of repairing or replacing a propeller.

It is an object of the present invention to provide a propeller guard that will meet the safety and performance objectives of known propeller guards while being constructed so as to be easily and inexpensively repairable if any damage occurs to the guard.

These and other objectives of the invention will be apparent from the following disclosure of a preferred embodiment thereof.

SUMMARY OF THE INVENTION

A propeller guard is provided with replaceable ribs that form a cage is placed around the propeller of an outboard marine propulsion unit. The ribs are suspended from a flat upper plate adapted to be bolted to a cavitation plate above the propeller. The ribs are maintained in spaced relation to each other around the propeller by the support plate and a longitudinally extending bottom bar bolted at one end to the skeg of the propulsion unit. In the event of damage to any of the ribs of the cage, the damaged rib can easily be replaced with a new one.

BRIEF DESCRIPTION OF THE DRAWINGS

The invention may best be understood with reference to the accompanying drawings wherein.

DESCRIPTION OF THE PREFERRED EMBODIMENT

Figure 1:
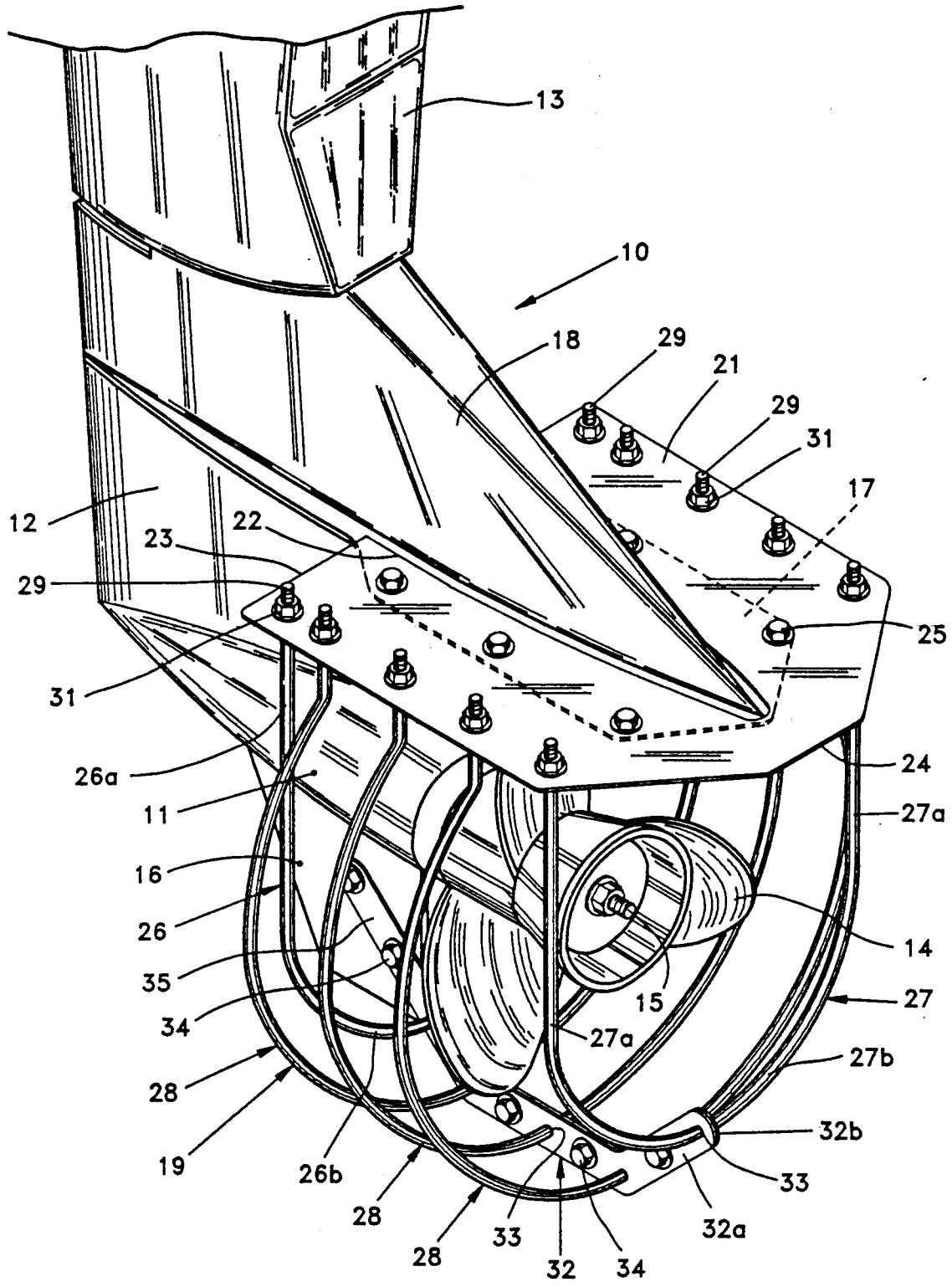
FIG. 1 is a perspective view of the lower end of a marine propulsion unit, such as an outboard motor, showing the propeller guard of the present invention.

Referring now to FIG. 1, there is shown the lower part of a marine propulsion unit, such as an outboard motor, generally designated 10. The motor 10 has a horizontally elongated propeller shaft housing 11 mounted on the lower end 12 of a vertical driveshaft housing 13. A shaft (not visible) is journalled in the propeller shaft housing. A marine propeller 14 is mounted on a threaded extension 15 at the rear end of the propeller shaft. A skeg 16 depends from the underside of the propeller shaft housing 11. A cavitation plate 17 is mounted on a rearward streamlined extension 18 of the driveshaft housing 13 so that the cavitation plate 17 is directly above the propeller 14.

The propeller guard 19 embodying the present invention comprises a flat support plate 21 having an elongated notch 22 extending from its front edge 23 toward its rear edge 24. The contour of notch 22 is complementary to the contour of the rearward extension 18 of the driveshaft housing 13 at the level of the cavitation plate 17. When the propeller guard 19 is mounted around the propeller 14, it preferably is bolted to the top of the cavitation plate 17 by six bolts 25. Alternatively, other modes of attachment may be used and more or less than six bolts may be used.

At each side of the driveshaft housing extension 18, the support plate 21 is provided with a row of bolt holes (not visible). The two rows of bolt holes are preferably equally laterally spaced from the drive shaft housing extension 18.

A plurality of ribs 26, 27 and 28 are suspended from the support plate 21 with the ribs extending transversely of the support plate 21 in spaced parallel relation to each other. More specifically, the front rib 26 adjacent the front end 23 of the support plate 21 is substantially U-shaped having straight leg portions **26*a* extending upwardly from the bight 26*b* of the U. The rear rib 27 adjacent the rear end 24 of the support plate 21 is also substantially U-shaped having straight leg portions 27*a* extending upwardly from the bight 27*b* of the U. The legs 27*a* of the rear rib 27 are preferably slightly shorter than the legs 26*a* of the front rib 26 since the front rib 26 may have to straddle a longer downwardly extending skeg 16** on some outboard motors.

The three central ribs 28 intermediate the front rib 26 and the rear rib 27 have a substantially circular configuration of a diameter substantially larger than the diameter of the propeller 14 to be housed in the propeller guard 19. When suspended from the support plate 21, the central ribs 28 form a chamber within which the propeller 14 is able to rotate without interference with the ribs forming the cage of the propeller guard 19.

Each of the front, rear and central ribs has a straight threaded end portion 29 that projects through one of the holes in the support plate 21. Each threaded end 29 receives two nuts, a first nut 31 threaded on the end portion 29 before it is inserted in a support plate hole and a second nut 31 threaded on the end portion 29 after the end portion 29 is inserted through the hole in the support plate 21. The support plate 21 can then be effectively clamped between the two nuts 31 to rigidly but removably hold the rib in place.

Figure 2:
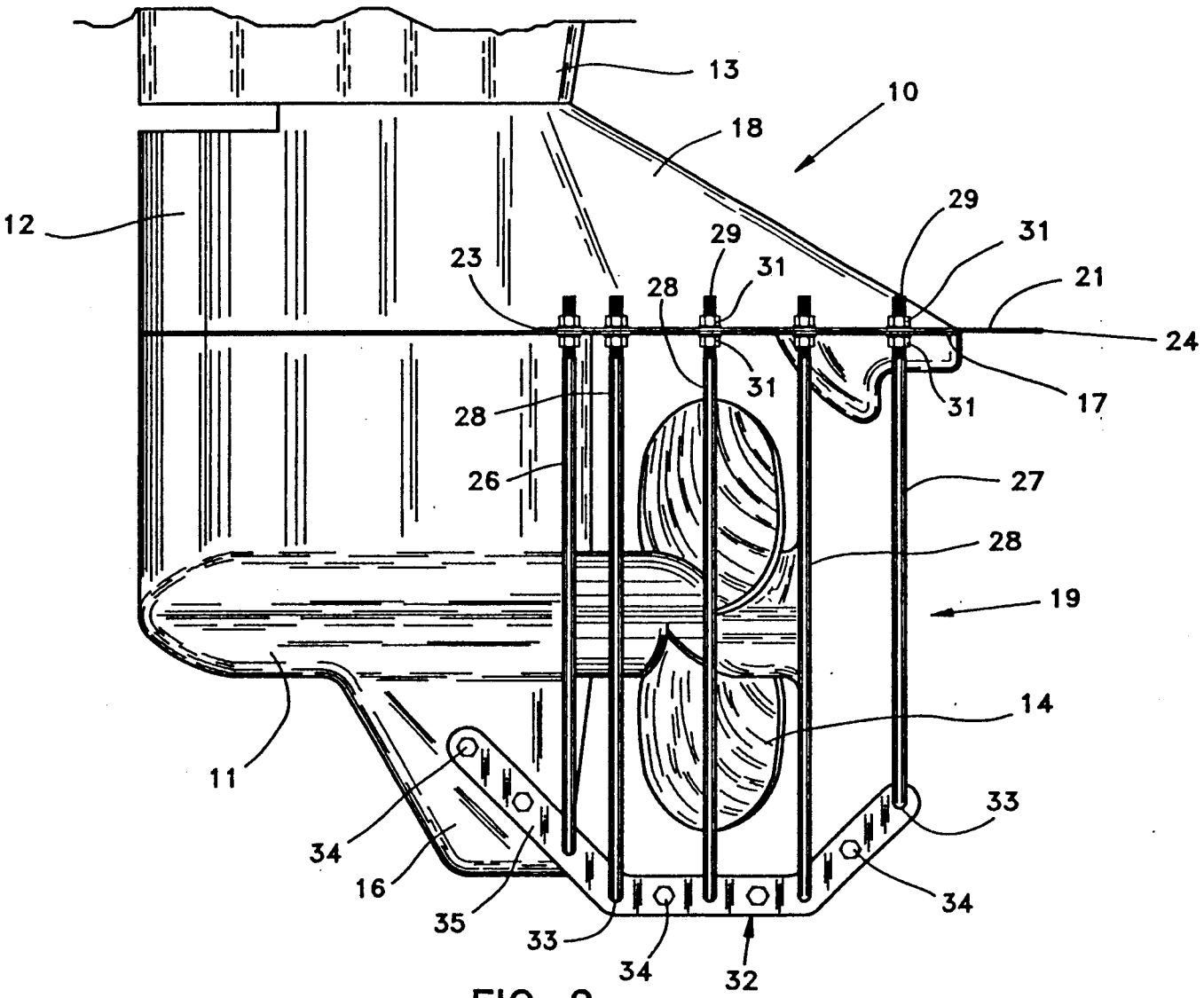
FIG. 2 is a side elevation view of FIG. 2.
Figure 3:
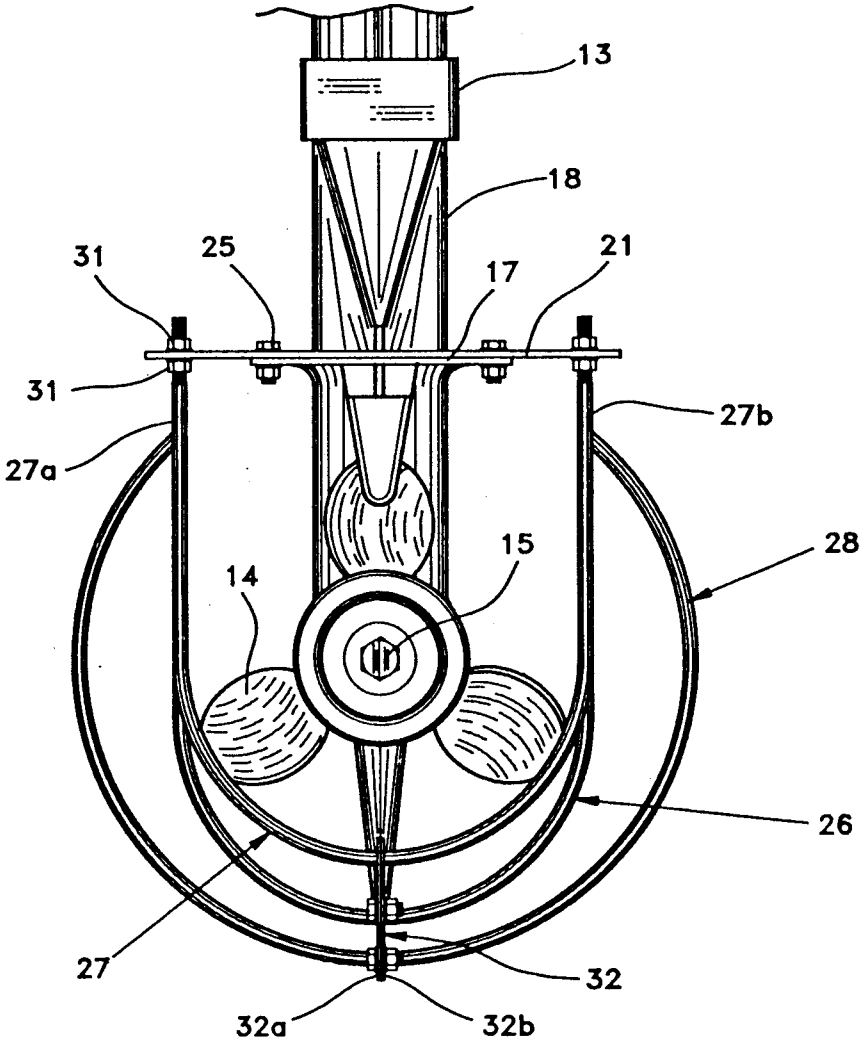
FIG. 3 is an end view of FIG. 1 looking toward the propeller.

When all of the ribs are attached to the support plate 21, each rib will extend transversely of the support plate 21 in a generally spaced parallel relationship to one another. To further reinforce the generally parallel relationship of the ribs, an elongated bar 32 is provided that coacts with the bight portions of the ribs to maintain the latter in the generally spaced parallel relationship established by the suspension of the ribs from the support plate 21, as best seen in FIG. 2. For ease of assembly 24 the elongated bar 32 is formed of two thin metal strips 32*a* and 32*b* having a series of holes 33 through which the bottom or bight portions of the ribs are threaded. The metal strips 32*a* and 32*b* are bolted together by a series of bolts 34.

At its front end the bar 32 has an upwardly angled extension 35. At the extension 35, the strips 32*a* and 32*b* are separated to enable them to be placed on opposite sides of the skeg 16 and attached to the skeg by means of bolts 34 or other suitable fastening devices.

As best seen in FIG. 1, the suspended ribs form a generally barrel-shaped cage that is open at both ends providing little resistance to water flow while protecting the propeller from side and end impacts.

The support plate 21, the ribs 26, 27 and 28, the bottom bar 32 and the necessary nuts and bolts can be furnished as a kit and preassembled before being installed on the marine propulsion unit. During the installation of the assembled cage to the marine unit, the middle one of the central ribs 28 becomes a guide to the proper fore and aft positioning of the cage. Preferably, the cage should be positioned so that the middle center rib 28 is aligned with the vertical centerline of the propeller, as best seen in FIG. 2.

The notch 22 in the supply plate 21 is slightly oversize so that its position on the cavitation plate 17 ca be adjusted before holes are drilled in the cavitation plate to receive the four retaining bolts 25. After the supply plate 21 is securely fastened, the holes in the front extension 35 of the bottom bar 32 can be used as a template for drilling the holes in the skeg 16 for the two bolts 34 for securing the bottom bar 32 to the skeg 16.

Figure 4:
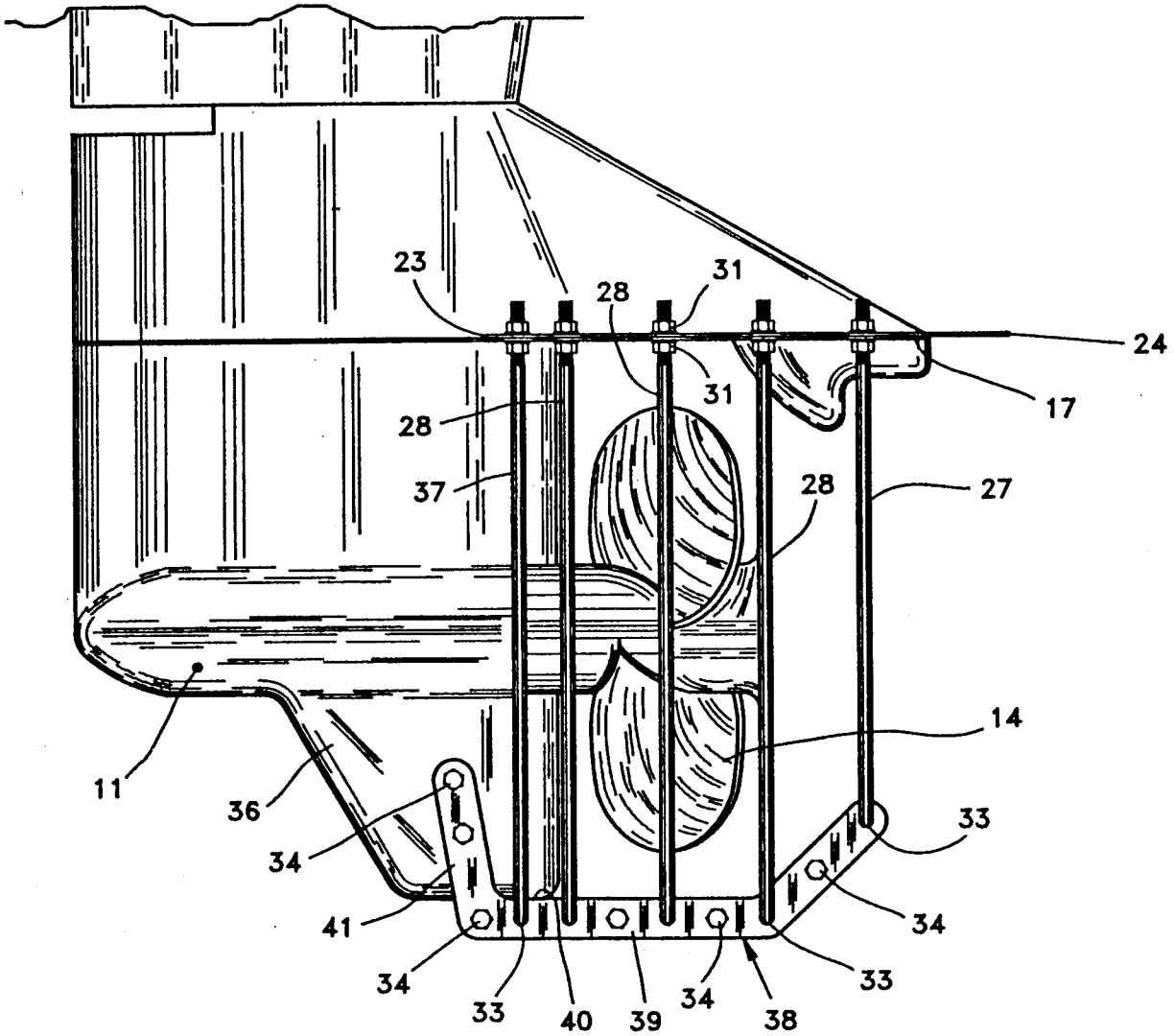
FIG. 4 is a side elevation view of a propeller guard of modified construction.

As shown in FIG. 4, the skeg 36 may be somewhat larger in depth and longer in length than the skeg 16 depicted in FIG. 2. Skeg sizes reflect the make, model and horsepower rating of the marine propulsion units. As a general rule, the higher the horsepower rating of the unit the larger the skeg will be.

The larger skeg 36 is accommodated by providing a front U-shaped rib 37 having a vertical length substantially equal to the vertical length of the central ribs 28. The bight of the rib 37 is able to clear the bottom edge 40 of the skeg 36.

The bottom bar 38 of the FIG. 4 embodiment has a horizontal section 39 somewhat longer than that of the bottom bar 32 of FIG. 2 to provide an anchorage for the bight of the rib 37.

In the FIG. 2 embodiment the bottom bar 32 was shown as having an upwardly angled extension 35 with the angle approximating 45 degrees. In the FIG. 4 embodiment, the angle of the upwardly extending end 41 of the bottom bar 38 approximates 75 degrees from the horizontal. The manner in which the bottom bar 38 is secured to the skeg is the same as described with respect to the bottom bar 32 attachment to the skeg 16.

Preferably, the propeller guard is constructed of marine grade aluminum that is alloyed with 4.0% magnesium, 0.45% manganese and 0.15% chromium. This alloy has a tensile strength of 40,000 to 54,000 psi and offers resistance to stress, water corrosion and superior resistance to atmospheric corrosion. The nuts and bolts construction of the propeller guard has the advantage that if any damage to the guard occurs it is only necessary to unbolt the damaged rib and repair or replace it with a new one.

While the invention has been described with respect to a preferred embodiment thereof, it will be readily apparent to those skilled in the art that certain modifications may be made within the spirit and scope of the invention. Accordingly, the invention should not be considered limited by the description of the single embodiment, but should rather be limited only by the following claims.

What is claimed is:

1. A propeller guard for a propeller mounted on a propeller shaft extending rearwardly from a propeller shaft housing of a marine propulsion unit having a cavitation plate above the propeller, comprising:

(a) an elongate support plate adapted to be secured to the cavitation plate, (b) a plurality of ribs independently suspended from the support plate, the ribs being formed of rod members having integrally formed end portions projecting through apertures in the support plate and having curved sections extending transversely beneath the support plate, the projecting rod end portions receiving removable fasteners securing the ribs to the support plate, the removable fasteners permitting individual damaged ribs to be removed and replaced, (c) the ribs forming a substantially cylindrical cage open at both ends adapted to encompass, the propeller, and (d) elongate bar means coacting with a bight on each of the curved sections of the ribs for maintaining the latter in a parallel relationship to each other.

2. A propeller guard according to claim 1, in which: the ribs include a rib to the rear of the propeller in which the curved section is substantially "U"-shaped and ribs forward of the rear rib in which the curved sections are substantially circular to accommodate the propeller.

3. A propeller guard according to claim 1, in which: the support plate has a longitudinally extending notch of a size adapted to span the driveshaft housing of the marine propulsion unit while providing for longitudinal positioning of the propeller guard relative to the propeller.

4. A propeller guard according to claim 1, in which: the elongate bar means comprises at least one member having a plurality of holes through which the bight of each rib curved section is received, the holes being spaced so that the bar means member maintains the ribs in a fixed spaced parallel relationship to each other below the propeller.

5. A propeller guard according to claim 4, in which:

the elongated bar means member has a forward end portion that overlies a portion of a skeg at the bottom of the marine propulsion unit, and removable fasteners hold the bar means member end portion to the skeg.

6. A propeller guard for the propeller of a marine propulsion unit, comprising:

(a) an elongated flat upper support plate, (b) a plurality of spaced ribs independently suspended from the support plate with the ribs extending transversely of the support plate in parallel relationship to each other, the ribs having integrally formed end portions extending through holes in the support plate, the end portions of the ribs being secured to the support plate by removable fasteners to permit damaged ribs to be removed and replaced, (c) the ribs forming a substantially cylindrical cage open at both ends adapted to encompass a propeller mounted at one end of a propeller shaft housing, and (d) an elongated bar below the propeller shaft housing coacting with the lower ends of the ribs to maintain the latter in the parallel relationship established by the suspension of the ribs from the support plate.

7. In combination with an outboard motor having a horizontally elongated propeller shaft housing mounted on the lower end of a vertical driveshaft housing, a horizontal shaft having a front end and a rear end with the front end of the shaft being journalled in the shaft housing, a marine propeller mounted on the rear end of the shaft, a skeg depending from the underside of the propeller shaft housing and a cavitation plate mounted driveshaft housing above the propeller, a propeller guard comprising:

(a) an elongated substantially flat support plate adapted to be removably secured to the cavitation plate by removable fasteners, (b) a plurality of rod-formed ribs independently suspended from the support plate, the ribs being longitudinally spaced along the propeller end of the propeller shaft housing and having integrally formed end portions fastened by removable fasteners to the support plate on opposite sides of the vertical driveshaft housing, the removable fasteners permitting one or more of the ribs to be removed and replaced if damaged during use, the rod-formed ribs forming beneath the support plate a substantially barrel-shaped cage open at both longitudinal ends, the cage longitudinally surrounding the rear end of the propeller shaft and the propeller mounted thereon, and (c) at least one longitudinally extend bar secured to the ribs below the propeller to maintain a predetermined longitudinal spacing between the ribs of the cage.

8. The combination according to claim 7, in which:

the ribs include a front rib and a rear rib are substantially "U"-shaped and ribs between the front and rear ribs that are substantially circular to accommodate the diameter of a rotating propeller therein.

9. The combination according to claim 8, in which:

the support plate has a longitudinally extending notch that is slightly larger than but complementary in shape to the driveshaft housing at the level of the cavitation plate to allow for fore-and-aft installation adjustments.

10. The combination according to claim 7, in which:

the elongate bar is releasably secured at the rear end of the cage to the skeg by removable fasteners.

11. The combination according to claim 7, in which:

the support plate overlies and is fastened to the cavitation plate at opposite sides of the vertical drive shaft housing by removable fasteners.

* * * * *